US006943490B2

(12) United States Patent
Lim et al.

(10) Patent No.: US 6,943,490 B2
(45) Date of Patent: Sep. 13, 2005

(54) DEFLECTION YOKE WITH IMPROVED DEFLECTION SENSITIVITY

(75) Inventors: Chang Ju Lim, Suwon-Shi (KR); Jae Jung Kim, Suwon-Shi (KR); Hwan Seok Choe, Suwon-Shi (KR)

(73) Assignee: Samsung Electro-Mechanics Co., Ltd., Kyungki-Do (KR)

( * ) Notice: Subject to any disclaimer, the term of this patent is extended or adjusted under 35 U.S.C. 154(b) by 0 days.

(21) Appl. No.: 10/322,386

(22) Filed: Dec. 13, 2002

(65) Prior Publication Data

US 2004/0007958 A1 Jan. 15, 2004

(30) Foreign Application Priority Data

Jul. 11, 2002 (KR) ..... 10-2002-0040442
Nov. 25, 2002 (KR) ..... 10-2002-0073551

(51) Int. Cl.[7] ..... H01J 29/70; H01J 29/76

(52) U.S. Cl. ..... 313/440; 313/441; 313/442; 313/430; 313/426; 313/427; 313/428; 335/209; 335/210; 335/211; 335/296

(58) Field of Search ..... 313/440–442, 313/413, 430–433, 426, 428; 335/209–214

(56) References Cited

U.S. PATENT DOCUMENTS 6,522,060 B2 * 2/2003 Kim ..... 313/440
6,590,329 B2 * 7/2003 Tagami ..... 313/440
6,624,560 B2 * 9/2003 Usami ..... 313/440
2002/0084739 A1 * 7/2002 Kim et al. ..... 313/440

FOREIGN PATENT DOCUMENTS

JP 2000113832 A * 4/2000 ..... H01J/29/76

* cited by examiner

*Primary Examiner*—Karabi Guharay
*Assistant Examiner*—Sikha Roy
(74) *Attorney, Agent, or Firm*—Darby & Darby

(57) ABSTRACT

A deflection yoke mounted on a rear portion of a cathode ray tube (CRT) to deflect an electron beam emitted from an electron gun of the CRT includes a coil separator mounted on the CRT, a horizontal deflection coil mounted on an inside of the coil separator, having a first section generating a horizontal deflection magnetic field deflecting the electron in a horizontal direction and having a first radius, having a second section generating a magnetic field to weaken the horizontal deflection magnetic field and having a second radius different from the first radius, a vertical deflection coil mounted on an outside of the coil separator and generating a vertical deflection magnetic field deflecting the electron beam in a vertical direction, and a ferrite core covering a portion of the vertical deflection coil to strengthen the horizontal deflection magnetic field and the vertical deflection magnetic field. Since the magnetic field of the second section is weakened, a beam strike neck (BSN) distance is improved, and a deflection sensitivity is improved.

14 Claims, 15 Drawing Sheets

<a-a'>

<b-b'>

<Inner diameter of a conventional deflection coil>

<Inner diameter of the deflection coil of the present invention>

DEFLECTION YOKE WITH IMPROVED DEFLECTION SENSITIVITY

CROSS-REFERENCE TO RELATED APPLICATION

This application claims to benefit of Korean Patent Application No. 2002-40442, filed Jul. 11, 2002, in the Korean Intellectual Property Office, the disclosure of which is incorporated herein by reference.

BACKGROUND OF THE INVENTION

1. Field of the Invention

The present invention relates to a deflection yoke, and more particularly, to a deflection yoke able to improve a deflection sensitivity without affecting other characteristics of a cathode ray tube.

2. Description of the Related Art

Generally, a deflection yoke used in a cathode ray tube (CRT) of a television or a monitor is one of various yoke types, such as a saddle-toroidal type and a saddle-saddle type.

FIG. 1 is a cross-sectional view of a conventional deflection yoke 1. The deflection yoke 1 is symmetrical and is provided with a coil separator 10 having a pair of portions formed in an integrated body.

The coil separators 10 includes a screen unit 11 corresponding to a screen 2*a* of the CRT, a middle unit 12 extended from the screen unit toward a rear side of the CRT, and a neck unit 13 formed with the middle unit 12 in a body and coupled to an electron gun of the CRT.

On an inside and an outside of the coil separator 10 are provided a horizontal deflection coil 14 having a pair of upper and lower portions generating a horizontal deflection magnetic field to deflect en electron beam in a horizontal direction and a vertical deflection coil 15 having a pair of left and right portions generating a vertical deflection magnetic field to deflect the electron beam in a vertical direction, respectively. The horizontal deflection coil 14 and the vertical deflection coil 15 are collectively called a deflection coil. A ferrite core 16 is provided on an outside of the vertical deflection coil 15 to strengthen the horizontal deflection magnetic field and the vertical deflection magnetic field.

The horizontal deflection coil 14 is formed with front and rear ends having an outward flange shape and is also formed with a bend generating an unnecessary magnetic field.

The deflection yoke 1 has a horn shape having a gentle curve formed between a front part and a rear part of the coil separator 10.

The horizontal and vertical deflection coils 14, 15 have the same horn shape as the coil separator 10.

The vertical deflection coil 15 may be formed in a toroidal shape in which a coil is wound around the ferrite core 16, and the vertical deflection coil 15 having the toroidal shape in the deflection yoke 1 is called a saddle-saddle type.

FIG. 2 is a cross-sectional view of a coil separator 10 of the conventional deflection yoke 1 shown in FIG. 1. In the coil separator 20 of the conventional deflection yoke 1, a rear area of the middle area 22 and the neck area 23 have the same diameter so that a horizontal surface H is formed on a rear area of the coil separator 20 in an axial direction of the CRT.

The middle area includes a horn shaped area 22*a* having a horn shaped curve, and a linear area formed in a linear line in the axial direction of the CRT.

FIG. 3 is a perspective view of a horizontal deflection coil 30 of the deflection yoke shown in FIG. 1, FIG. 4 is a diagram showing the horizontal deflection coil 30 shown in FIG. 3, FIG. 5 is a side view of the horizontal deflection coil shown in FIG. 3, and FIG. 6 is a cross-sectional view taken along a–a' and b–b' of FIG. 5.

The horizontal deflection coil 30 as shown in FIGS. 3 through 6, is a non-bent type without the outward flange shape. Since a vertical deflection coil and the horizontal deflection 30 are the same in structure, an explanation of the vertical deflection coil will be omitted.

The horizontal deflection coil 30 includes a screen bent portion 31, an extension portion 32, and a neck bent portion 33 corresponding to the screen area 21, the middle area 22, and the neck area 30 of the coil separator 20, respectively.

The extension portion 32 is formed on a rear side of the screen bent portion 31, and the neck bent portion 33 is formed on a rear side of the extension portion 32 to form a single body with the extension portion 32.

The extension portion 32 includes a horn shaped portion 32*a* having a horn shaped curve, and a linear portion having a straight line in the axial direction of the CRT. The extension portion 32 generates the horizontal deflection magnetic field for deflecting the electron beam in the horizontal direction. The neck bent portion 33 generates an unnecessary magnetic field which does not contribute to generating of the horizontal deflection magnetic field, and is called a non-effective bent area.

As shown in FIGS. 4 through 6, an inside radius (DSO, DL) and an outside radius (FSO, FL) are formed in the horizontal deflection coil 30 from the horn shaped portion 32*a* to a rear portion of the neck bent portion 33. DSO and DL represent the inside radius in the vertical direction and the horizontal direction, respectively, and FSO and FL represent the outside radius in the vertical direction and the horizontal direction, respectively.

Since the unnecessary magnetic field is generated in the neck bent portion 33, a beam strike neck (BSN) distance is shortened due to the unnecessary magnetic field.

The BSN distance is a movement distance of a deflection point at which the electron beam starts to be deflected by the horizontal or vertical deflection magnetic field toward a predetermined position of a screen of the screen unit 11, and the BSN distance is disposed to be shifted toward the electron gun by the movement distance since the deflection yoke 1 is not closely attached to a rearmost portion of the CRT but is installed to be spaced-apart from the rearmost portion of the CRT according to the movement distance.

The movement distance of the BSN is called the BSN distance. If the BSN distance is lengthened, the electron beam is able to reach an outermost peripheral portion of the screen of the CRT due to a maximum deflection of the electron beam. However, if the BSN distance is shortened, the electron beam is not able to reach the outermost peripheral portion of the screen of the CRT but strikes an inner surface of the CRT. As a result, a dark area is shown in a corner of the screen, and it is impossible to properly display a display image on the screen.

FIGS. 7A through 8 describe a state that the electron beam is influenced by the horizontal deflection magnetic field generated from the extension portion 32 of the horizontal deflection coil 30 and a magnetic field (another vertical deflection magnetic field) generated from the neck bent portion 33.

FIGS. 7A, 7B, and 7C are diagrams showing magnetic fields generated from the horizontal deflection coil 30 shown in FIG. 3, and FIG. 8 is a diagram showing a relationship between the electron beam and the magnetic field generated from a neck bent portion 33 of the horizontal deflection coil 30 shown in FIG. 3.

As shown in FIGS. 7A and 7B, the diagram of FIG. 7B which is taken along a line a–a' of FIG. 7A, shows that a horizontal deflection force F1 is generated in a horizontal deflection magnetic field B1 of the extension portion 32 of the horizontal deflection coil 30, and the electron beam emitted from an electron gun 2*b* is deflected in an X direction.

Current I is defined by a reversed direction opposite to an emitting direction of the electron beam of the electron gun 2*b*, that is, an reversed direction of the electron beam. The horizontal deflection force F1 corresponds to a first magnetic force B1 generated by the current I flowing through the extension portion 32 as shown in FIG. 7A.

The diagram of FIG. 7C which is taken along a line b—b of FIG. 7A, describes that a vertical deflection magnetic field B2 is generated from the neck bent portion 33 of the horizontal deflection coil 30 in a direction opposite to the electron beam due to the current flowing in the horizontal direction. As a result, a vertical deflection force F2 is generated in a Y direction toward a top portion of the neck bent portion 33. The vertical deflection force F2 corresponds to a second magnetic force B2 generated by the current I flowing through the neck bent portion 33 as shown in FIG. 7A.

The vertical deflection force F2, which is generated by the vertical deflection magnetic field B2 of the neck bent portion 33 of the horizontal deflection coil 30, does not strengthen the horizontal deflection force F1 deflecting the electron beam in the horizontal direction but weakens the horizontal force F1 by deflecting the electron beam a direction other than the X direction, thereby causing the BSN distance to be shortened.

The vertical deflection magnetic field B2 is formed in a fan shape in an outward radial direction due to a round shape of the neck bent portion 33. Since the vertical deflection magnetic field B2 is generated in a corner area of the neck bent portion 33 in a diagonal direction with respect to the direction of the electron beam, the electron beam is influenced by the vertical deflection magnetic field B2 as shown in FIG. 8.

R, G, B electron beams GB are not formed in a single spot on the screen but are formed on a line, and a gap is formed between the adjacent R, G, B electron beams as shown in FIG. 8.

The R, G, and B electron beams are focused toward the single spot, and the R and B electron beams GB are inclined with respect to the G electron beam.

The current I is defined in the reversed direction opposite to the emitting direction of the electron beam emitted from the electron gun 2*b*, and an inclined angle θ is formed between the reversed direction of the current I and the vertical deflection magnetic field B2 formed in a direction opposite to the emitting direction of the electron beam.

Since the inclined angle θ corresponds to sin θ according to vector F=IB sin θ, a deflection force F deflecting the electron beam is generated in the neck bent portion 33 of the horizontal deflection coil 30 Since the inclined angle θ becomes greater in the vertical deflection magnetic field B2 generated in the diagonal direction in the corner area of the neck bent portion 33, the electron beam disposed in an area corresponding to the corner area of the neck bent portion 33 is deflected greater than other electron beam disposed in other area.

However, the vertical deflection magnetic field B2 is not significant compared to the horizontal deflection magnetic field B1 generated from the horizontal deflection coil 30. Therefore, the vertical deflection magnetic field B2 does not affect a horizontal deflection of the electron beam. However, a problem that the BSN distance is shortened due to the vertical deflection magnetic field B2 occurs.

FIG. 9 is a diagram showing a scanning state of the electron beam according to a current of the horizontal deflection coil 30 of the conventional deflection yoke shown in FIG. 1. The scanning state shows a state of the electron beam scanned according to the current I flowing through the horizontal deflection coil 30.

The electron beam horizontally deflected by the horizontal deflection coil 30 is horizontally scanned on the screen 2*a* of the CRT according to a saw-type current IR, IL flowing through the horizontal deflection coil 30.

The electron beam is horizontally deflected toward a rightmost side of the screen 2*a* in response to a maximum current IR and toward a leftmost side of the screen 2*a* of the screen unit 11 in response to a minimum current IL. This correlation between a scanning width and respective magnitude of the current IR, IL corresponds to a deflection sensitivity.

The deflection sensitivity is represented by a formula of a product of an inductance L (inductance of the horizontal deflection coil 30) and a square $I^2$ of the current I flowing through the horizontal deflection coil 30).

$$\text{horizontal deflection sensitivity } mHA^2 = I^2 \times L \qquad \text{FORMULA}$$

That is, the deflection sensitivity of the horizontal deflection coil 30 is a product of the inductance L and a square of the maximum current IR and/or the minimum current IL An efficiency of the CRT is improved when a consumed current is small during deflecting the electron beam to the rightmost side and the leftmost side of the screen 2*a*. Accordingly, the defection sensitivity is improved when a value of the deflection sensitivity is small.

The deflection sensitivity is defined by respective final values of the inductance L and the current I consumed when the electron beam reaches the rightmost side and the leftmost side of the screen 2*a*.

In order to improve the deflection sensitivity, the inside radius DL, DSO and the outside radius FL, FSO of the horizontal deflection coil 30 should be shortened. However, there is a limitation in minimizing the inside radius DL, DSO and the outside radius FL, FSO of the horizontal deflection coil 30 since the inside radius DL, DSO and the outside radius FL, FSO of the horizontal deflection coil 30 should be larger than a diameter of the electron gun 2*b* when the deflection yoke 1 is mounted on the CRT.

FIG. 10 is a diagram showing the deflection sensitivity and a BSN phenomenon of the horizontal deflection coil 30 of the conventional deflection yoke 1 shown in FIG. 1. As shown in FIG. 10, the BSN phenomenon occurs when the deflection yoke 1 is not disposed close to a rear side of the CRT but moves toward the electron gun 2*b*, and the electron beam is not able to reach a maximum point of the screen 2*a* which is disposed in one of the corner area, the rightmost side, and the leftmost side of the screen 2*a*, thereby generating a dark image in the corner area of the screen 2*a* since the electron beam strikes the rear side of the CRT as indicated in a broken line GB3 of FIG. 10.

The deflection yoke 1 first closely sticks to the rear side of the CRT and then moves backward toward the electron gun 2*b* during adjusting a convergence of the CRT. The maximum point is the corner area disposed in uppermost and lowermost sides of the screen 2*a*.

When the deflection yoke 1 moves backward, an adjustment degree of the deflection yoke 1 is improved, and a manufacturing efficiency of the CRT is improved since the deflection yoke 1 is moved in one of upper, lower, horizontal, and vertical directions to adjust the convergence of the CRT.

If a backward moving distance of the deflection yoke 1 toward the electron gun 2*b* is lengthened, the adjustment degree of the deflection yoke 1 becomes improved. It is necessary to obtain a maximum value of the backward moving distance of the deflection yoke 1 as long as the BSN phenomenon is prevented.

In the correlation between the deflection sensitivity and the BSN phenomenon, the deflection sensitivity is inverse proportional to the BSN phenomenon. If the deflection sensitivity of the deflection yoke 1 is strengthened, an deflection angle of the electron beam increases since the magnetic field is strengthened, and the BSN distance is shortened. To the contrary, if the deflection sensitivity of the deflection yoke 1 is lowered, the deflection angle of the electron beam decreases since the magnetic field is weakened, and the BSN distance is lengthened.

That is, the BSN phenomenon becomes worsened according to the shortened BSN distance and the improved deflection sensitivity, and the BSN phenomenon becomes improved according to the lengthened BSN distance and the lowered deflection sensitivity.

When two different deflection yoke 1 having two different deflection sensitivities are closely attached to the rear side of the CRT, the electron beam is deflected as indicated as a beam path GBlwhen the deflection yoke 1 has the strengthened deflection sensitivity, and the electron beam is deflected as indicated as another beam path GB2 when the deflection yoke 1 has the lowered deflection sensitivity.

The beam path GB1 of the electron beam is moderately deflected compared to the consumed current of the deflection yoke 1 and is not able to reach the maximum point of the screen 2*a*, and the beam path GB2 of the electron beam is able to reach the maximum point of the screen 2*a*.

The deflection efficiency of the deflection yoke 1 is not improved in accordance with the strengthened (worsened) deflection sensitivity of the deflection yoke 1 and is improved due to the lowered (improved) deflection sensitivity of the deflection yoke 1.

When the deflection coil 30 moves backward toward the electron gun 2*b*.of the CRT to the adjust the convergence, a deflection point moves to a position f', and the BSN phenomenon that the electron beam strikes an inside surface of the electron gun 2*b* of the CRT occurs according to a movement of the deflection point as indicated as GB3 of FIG. 10.

The BSN distance is represented by a movement of the deflection point, i.e., a moving distance of the deflection yoke 1, and is defined by a distance between the positions f and f' as shown in FIG. 10.

Therefore, the beam path GB1 of the electron beam in the CRT having the strengthened deflection sensitivity shows that the deflection point of the BSN phenomenon (BSN distance) is shortened according to the distance between the positions f and f'. The beam path GB2 of the electron beam in the CRT having the lowered deflection sensitivity shows that the deflection point of the BSN phenomenon (BSN distance) is lengthened according to the distance between the positions f and f'.

The deflection sensitivity may be too much strengthened (worsened) in favor of an increase of the BSN distance. However, the CRT should be designed to have the improved (lowered) deflection sensitivity rather than the increase of the BSN distance since the deflection sensitivity is a primary concern and a major factor in designing the CRT.

Accordingly, it is desirable to design the deflection yoke 1 having the improved (lowered) deflection sensitivity and the lengthened BSN distance.

The vertical deflection magnetic field B2 generated from the neck bent portion 33 of the horizontal deflection coil 30 deflects the electron beam in the vertical direction and causes the BSN distance to be shortened. Particularly, the vertical deflection magnetic field B2 having a component generated from a corner portion of the neck bent portion 33 in the diagonal direction cause the BSN distance to be more shortened due to the enlarged inclined angle θ.

As described above, it is disadvantageous in the deflection yoke 1 of the conventional CRT to shorten the BSN distance although the deflection sensitivity is slightly improved because the deflection yoke 1 is first closely attached to the rear side of the CRT and then moves backward toward the electron gun 2*b*.

When the BSN distance is lengthened when the deflection yoke 1 moves backward toward the electron gun 2*b*, the deflection sensitivity decreases due to an increase of a value of the deflection sensitivity.

According to a movement of the deflection yoke 1 in the backward direction toward the electron gun 2*b*, the BSN distance is shortened, and the electron beam is not able to reach the maximum point of the screen 2*a* but strikes an inside surface of the rear side of the CRT, thereby causing a portion of a display image not to be displayed on the screen 2*a*.

SUMMARY OF THE INVENTION

In order to solve the above and other problems, it is an aspect to provide a deflection yoke able to improve a deflection sensitivity as well as a beam strike neck (BSN) distance when the deflection yoke is mounted on a rearmost side of a cathode ray tube (CRT) to adjust a convergence of the CRT.

Additional aspects and advantages of the invention will be set forth in part in the description which follows and, in part, will be obvious from the description, or may be learned by practice of the invention.

To achieve the above and/or other aspects, a deflection yoke mounted on a rear portion of a cathode ray tube (CRT) to deflect an electron beam emitted from an electron gun of the CRT comprises a coil separator mounted on the CRT, a horizontal deflection coil mounted on an inside of the coil separator, having a first section generating a horizontal deflection magnetic field deflecting the electron in a horizontal direction and having a first radius, and having a second section generating a magnetic field to weaken the horizontal deflection magnetic field and having a second radius different from the first radius, a vertical deflection coil mounted on an outside of the coil separator and generating a vertical deflection magnetic field deflecting the electron beam in a vertical direction, and a ferrite core covering a portion of the vertical deflection coil to strengthen the horizontal deflection magnetic field and the vertical deflection magnetic field.

According to another aspect of the invention, an inside radius of the second section is different from that of the first section.

According to another aspect of the invention, an outside radius of the second section is different from that of the first section.

According to another aspect of the invention, the first section radius of the second section is greater than the second section of the first section According to another aspect of the invention, an outside radius of the second section is greater than that of the first section.

According to another aspect of the invention, the outside radius of the second section is greater than that of the first section.

According to another aspect of the invention, the second section comprises a first sub-section radius in a first direction and a second sub-section radius in a second direction perpendicular to the first direction, and the first sub-section radius is different from the second sub-section radius.

According to another aspect of the invention, the second section comprises a first sub-inside radius in a first direction and a second sub-inside radius in a second direction perpendicular to the first direction, and the first sub-inside radius is different from the second sub-inside radius.

According to another aspect of the invention, the second section comprises a first sub-outside radius in a first direction and a second sub-outside radius in a second direction perpendicular to the first direction, and the first sub-outside radius is different from the second sub-outside radius.

According to another aspect of the invention, the coil separator comprises another first section corresponding to the first section of the horizontal deflection coil and having a first inside radius, and another second section corresponding to the second section of the horizontal deflection coil and having a first inside radius different from the first inside radius.

According to another aspect of the invention, a deflection yoke mounted on a rear portion of a cathode ray tube (CRT) to deflect an electron beam emitted from an electron gun of the CRT, comprises a coil separator mounted on the CRT, a horizontal deflection coil mounted on an inside of the coil separator and generating a horizontal deflection magnetic field deflecting the electron in a horizontal direction, a vertical deflection coil mounted on an outside of the coil separator, having a first section generating a vertical deflection magnetic field deflecting the electron in a vertical direction and having a first section radius, and having a second section generating an unnecessary magnetic field weakening the vertical deflection magnetic field and having a second section radius different from the first section radius, and a ferrite core covering a portion of the vertical deflection coil to strengthen the horizontal deflection magnetic field and the vertical deflection magnetic field.

According to another aspect of the invention, an inside radius of the second section is different from that of the first section.

According to another aspect of the invention, an outside radius of the second section is different from that of the first section.

According to another aspect of the invention, the second section radius of the second section is greater than the first section radius of the first section According to another aspect of the invention, the outside radius of the second section is greater than that of the first section.

According to another aspect of the invention, the outside radius of the second section is greater than that of the first section.

According to another aspect of the invention, the second section comprises a first sub-section radius in a first direction and a second sub-section radius in a second direction perpendicular to the first direction, and the first sub-section radius is different from the second sub-section radius.

According to another aspect of the invention, the second section comprises a first sub-inside radius in a first direction and a second sub-inside radius in a second direction perpendicular to the first direction, and the first sub-inside radius is different from the second sub-inside radius.

According to another aspect of the invention, the second section comprises a first sub-outside radius in a first direction and a second sub-outside radius in a second direction perpendicular to the first direction, and the first sub-outside radius is different from the second sub-outside radius.

According to another aspect of the invention, the coil separator comprises another first section corresponding to the first section of the horizontal deflection coil and having a first inside radius, and another second section corresponding to the second section of the horizontal deflection coil and having a first inside radius different from the first inside radius.

BRIEF DESCRIPTION OF THE DRAWINGS

These and other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
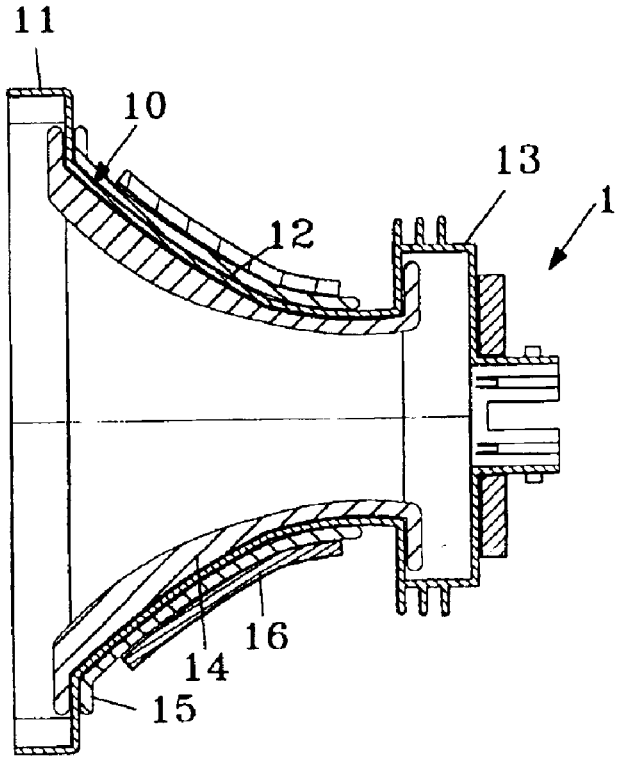
FIG. 1 (PRIOR ART)
FIG. 1 is a cross-sectional view of a conventional deflection yoke.
Figure 2:
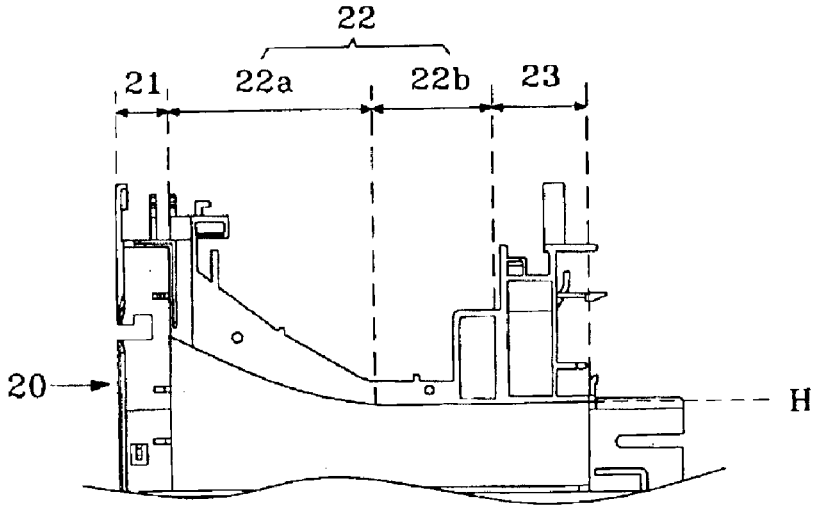
FIG. 2 (PRIOR ART)
FIG. 2 is a cross-sectional view of a coil separator of the deflection yoke shown in FIG. 1.
Figure 3:
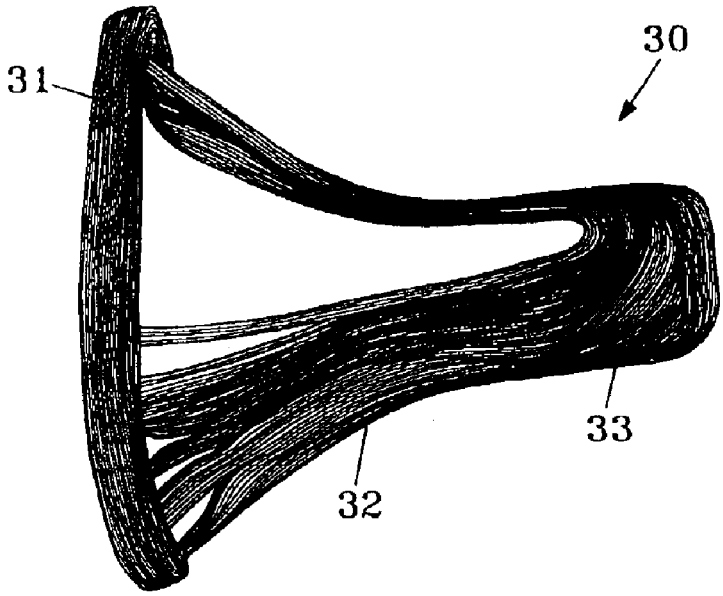
FIG. 3 (PRIOR ART)
FIG. 3 is a perspective view of a horizontal deflection coil of the deflection yoke shown in FIG. 1.
Figure 4:
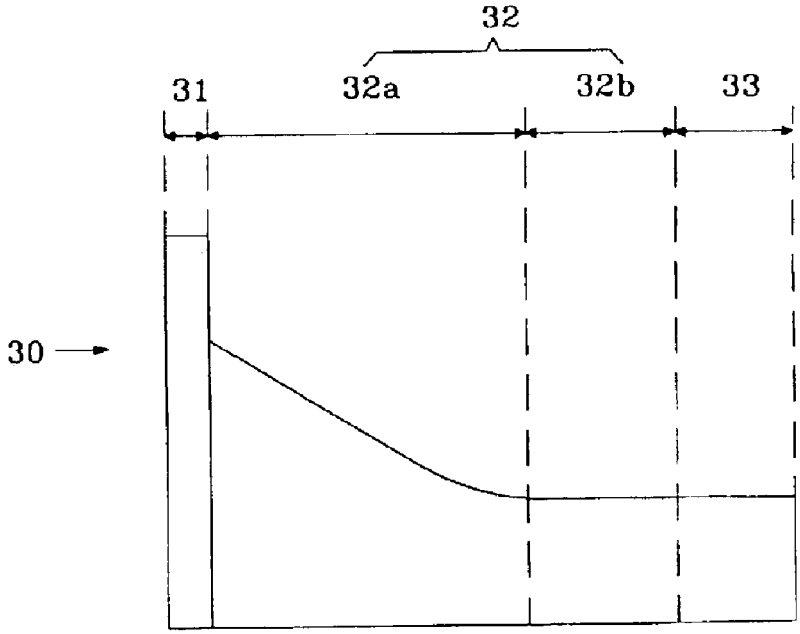
FIG. 4 (PRIOR ART)
FIG. 4 is a diagram showing the horizontal deflection coil shown in FIG. 3.
Figure 5:
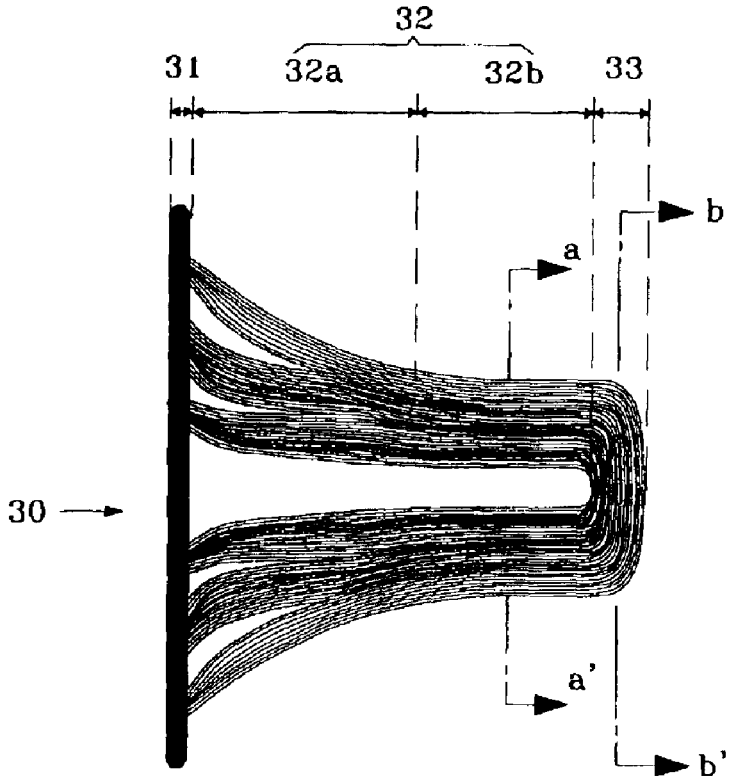
FIG. 5 (PRIOR ART)
FIG. 5 is a side view of the horizontal deflection coil shown in FIG. 3.
Figure 6:
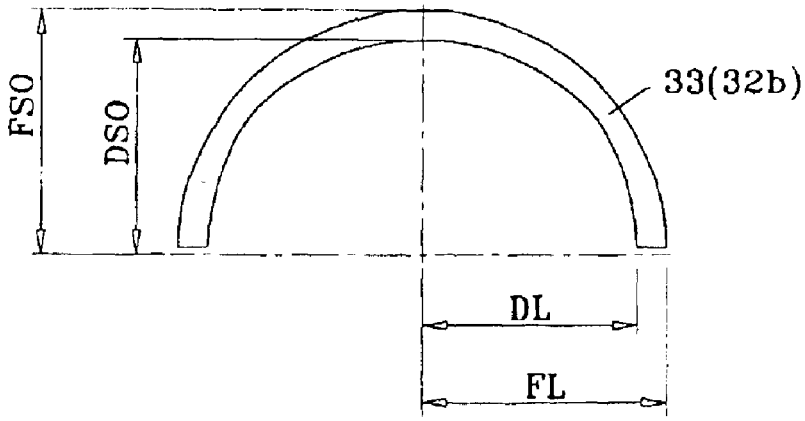
FIG. 6 (PRIOR ART)
FIG. 6 is a cross-sectional view of the horizontal deflection coil taken along a—a and b—b of FIG. 5.
Figure 7A:
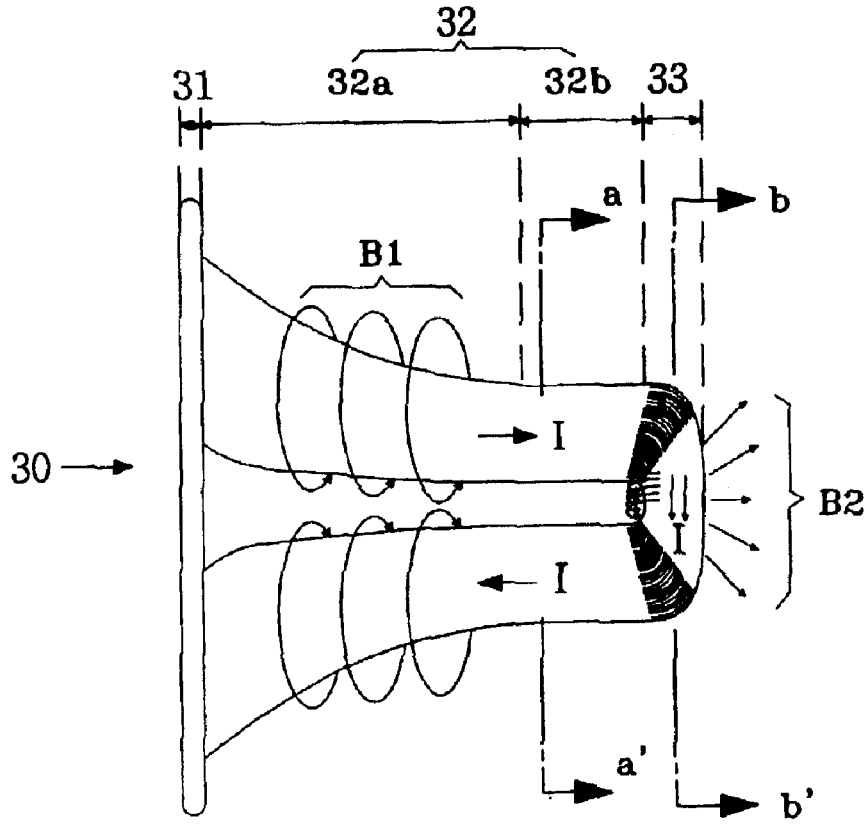
FIG. 7A (PRIOR ART)
FIGS. 7A, 7B, and 7C are diagrams showing a magnetic field generated from the horizontal deflection coil shown in FIG. 3.
Figure 7B:
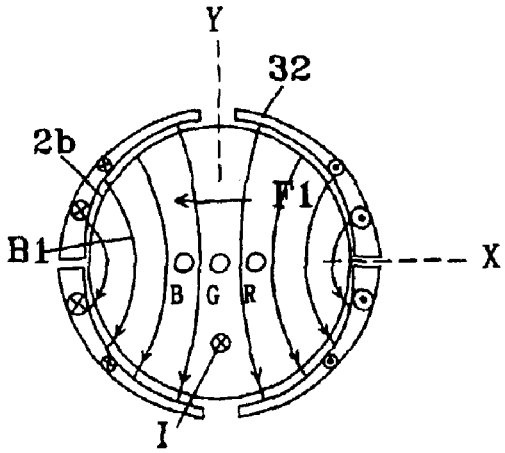
FIG. 7B (PRIOR ART)
Figure 7C:
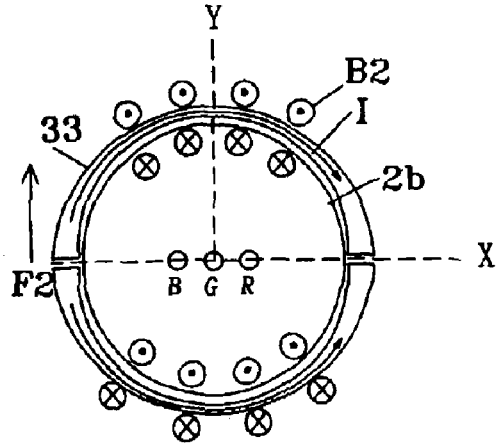
FIG. 7C (PRIOR ART)
Figure 8:
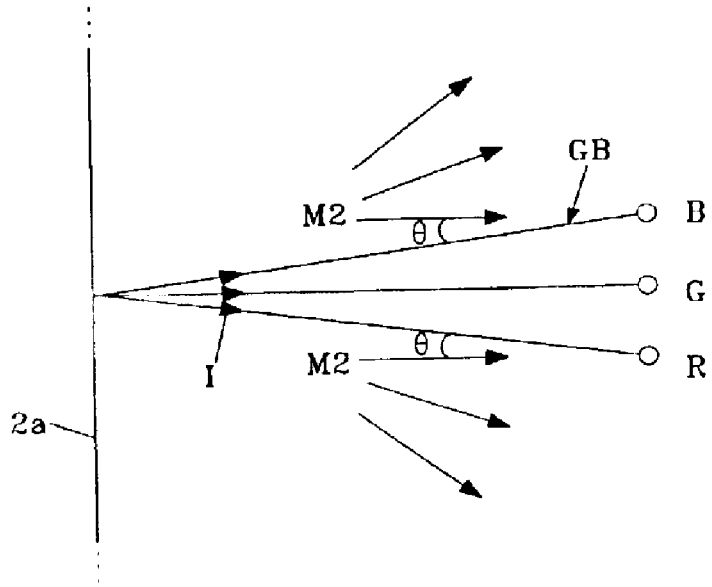
FIG. 8 (PRIOR ART)
FIG. 8 is a diagram showing a relationship between an electron beam and a magnetic field generated from a neck bent portion of the horizontal deflection coil shown in FIG. 3.
Figure 9:
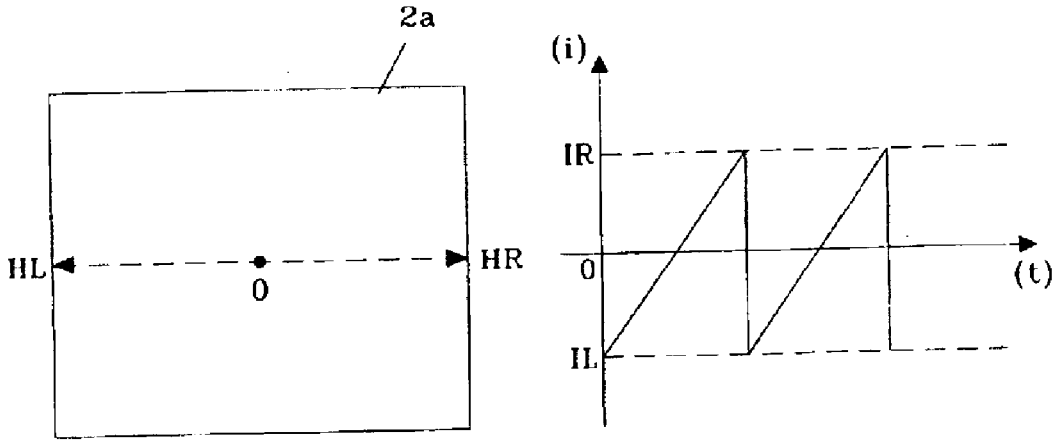
FIG. 9 (PRIOR ART)
FIG. 9 is a diagram showing a scanning state of the electron beam according to a current of the horizontal deflection coil of the conventional deflection yoke shown in FIG. 1.
Figure 10:
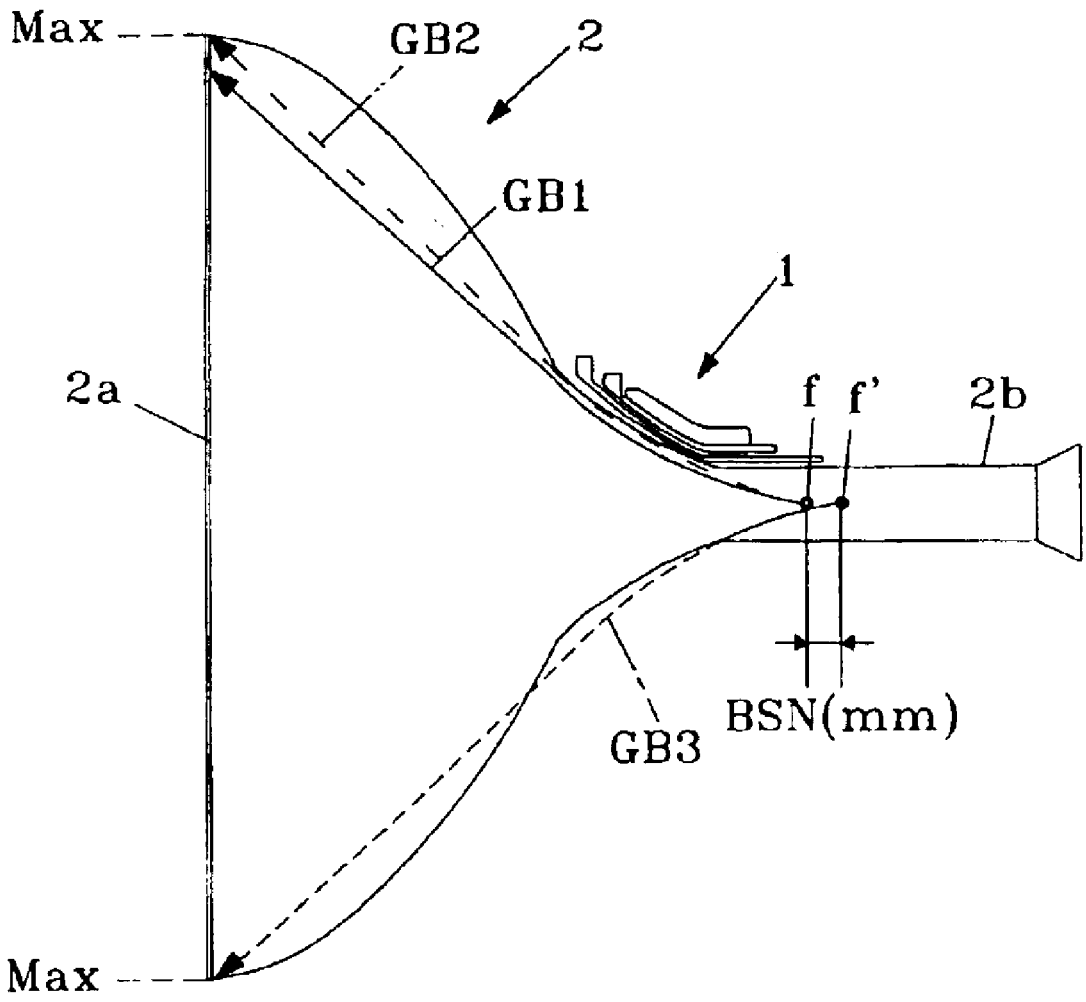
FIG. 10 (PRIOR ART)
FIG. 10 is a diagram showing a deflection sensitivity and a BSN phenomenon of the horizontal deflection coil of the conventional deflection yoke shown in FIG. 1.

Reference will now be made in detail to the present preferred embodiments of the present invention, examples of which are illustrated in the accompanying drawings, wherein like reference numerals refer to the like elements throughout. The embodiments are described below in order to explain the present invention by reference to the figures.

Hereinafter, an embodiment of a deflection yoke in a cathode ray tube (CRT) is explained in conjunction with the accompanying drawings.

Figure 11:
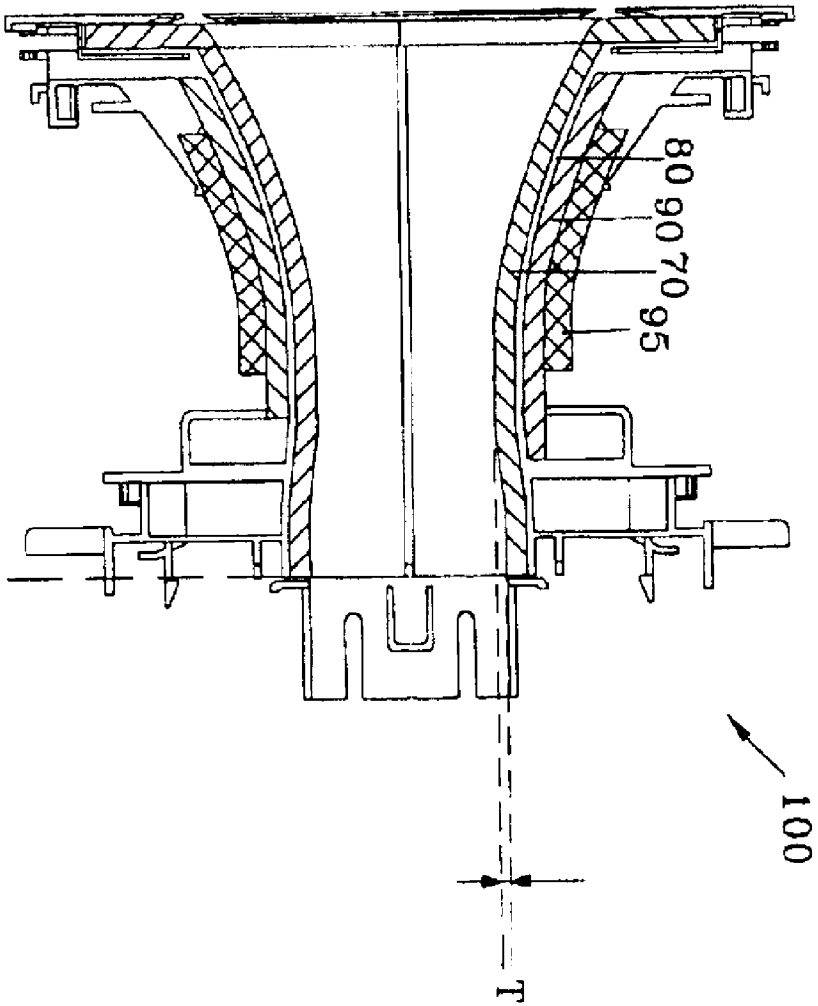
FIG. 11 is a cross-sectional view of a deflection yoke according to an embodiment of the present invention.
Figure 12:
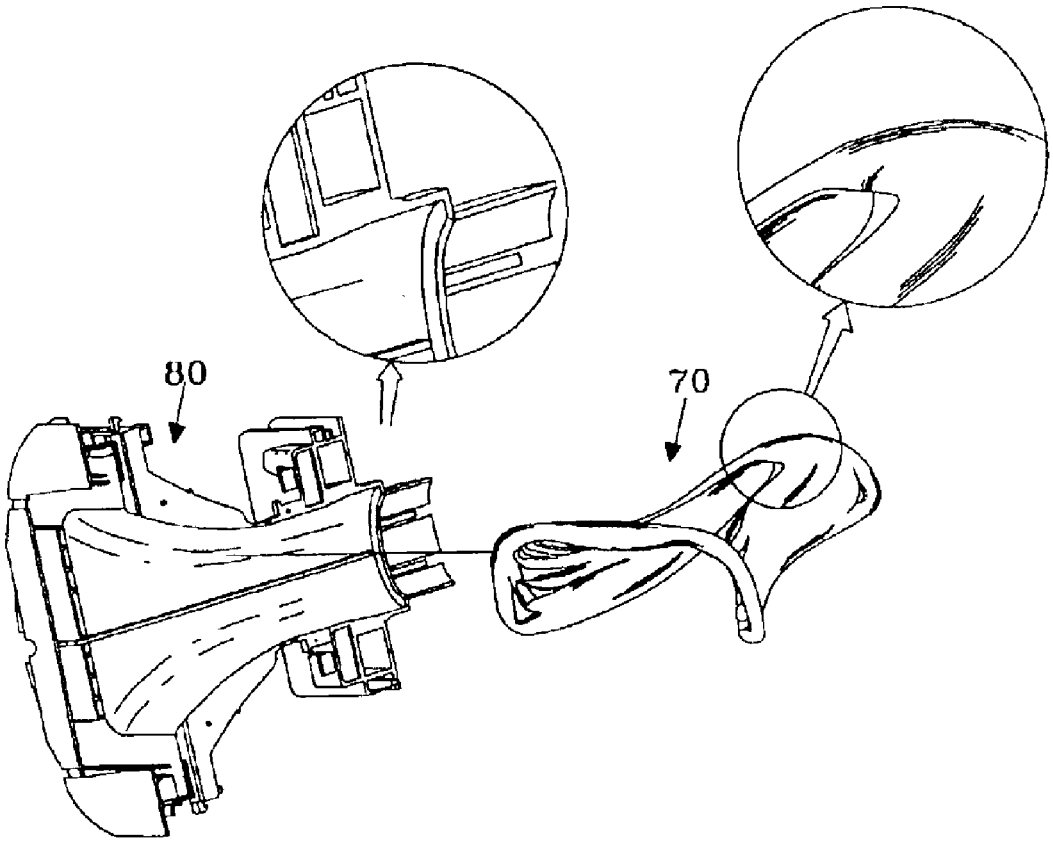
FIG. 12 is an exploded view of a coil separator and a horizontal deflection coil of the deflection yoke shown in FIG. 11.

FIG. 11 is a cross-sectional view of a deflection yoke 100 according to an embodiment of the present invention, FIG. 12 is an exploded view of a coil separator 80 and a horizontal deflection coil 70 of the deflection yoke 100 shown in FIG. 11, FIGS. 13A, 13B, and 13C are a cross-sectional view of the coil separator 80, a cross-sectional view of the horizontal deflection coil 70, and a plan view of the horizontal deflection coil 70, respectively.

Figures 13A, 13B, 13C:
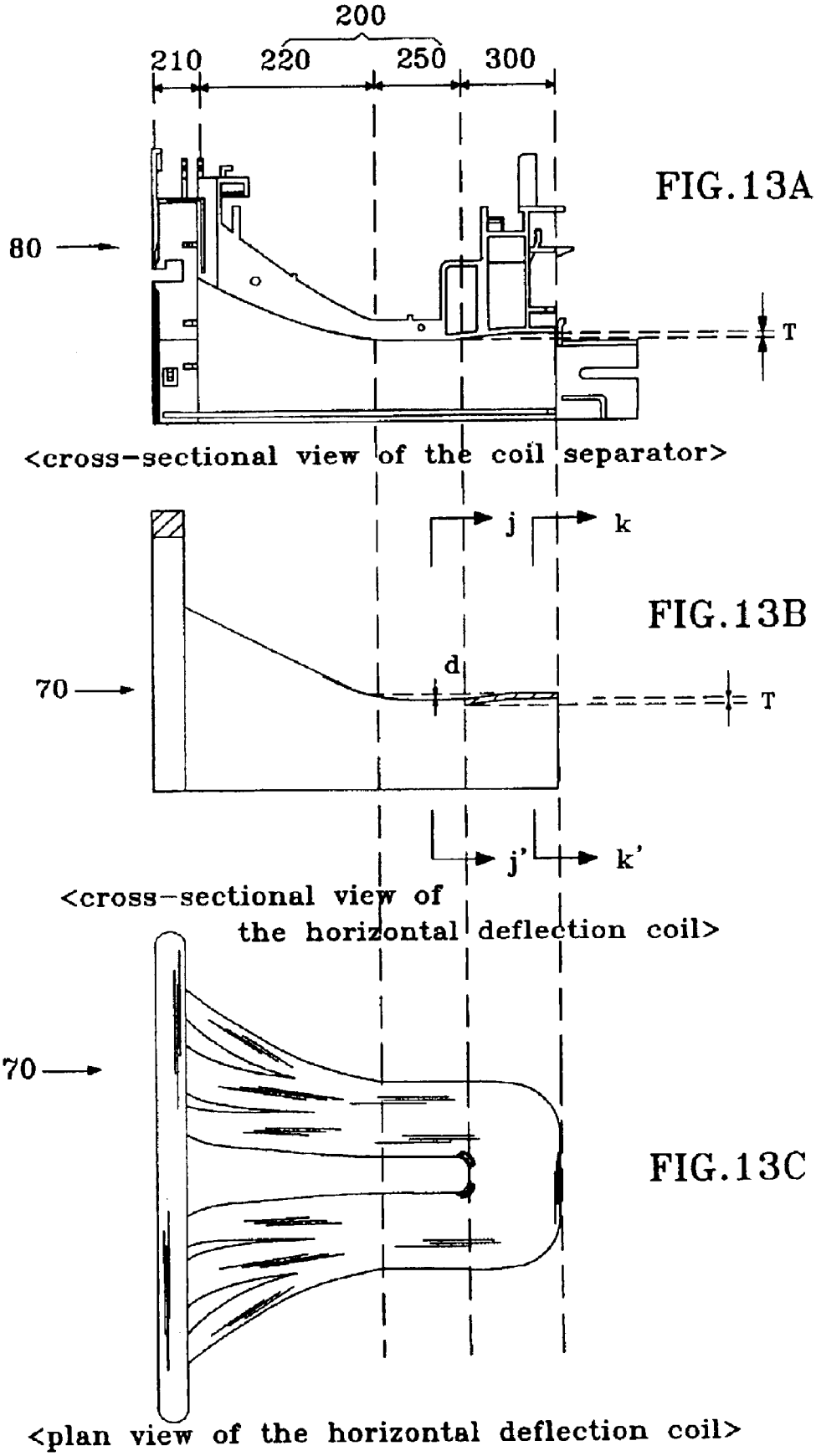
FIGS. 13A, 13B, and 13C are a cross-sectional view of the coil separator, a cross-sectional view of the horizontal deflection coil, and a plan view of the horizontal deflection coil, respectively.
Figure 14:
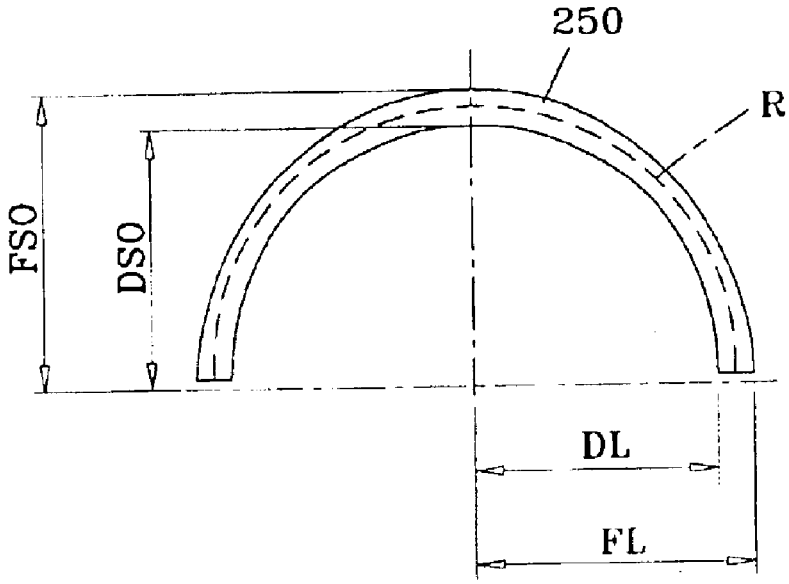
FIG. 14 is a cross-sectional view taken along j–j' of FIG. 13B.
Figure 15:
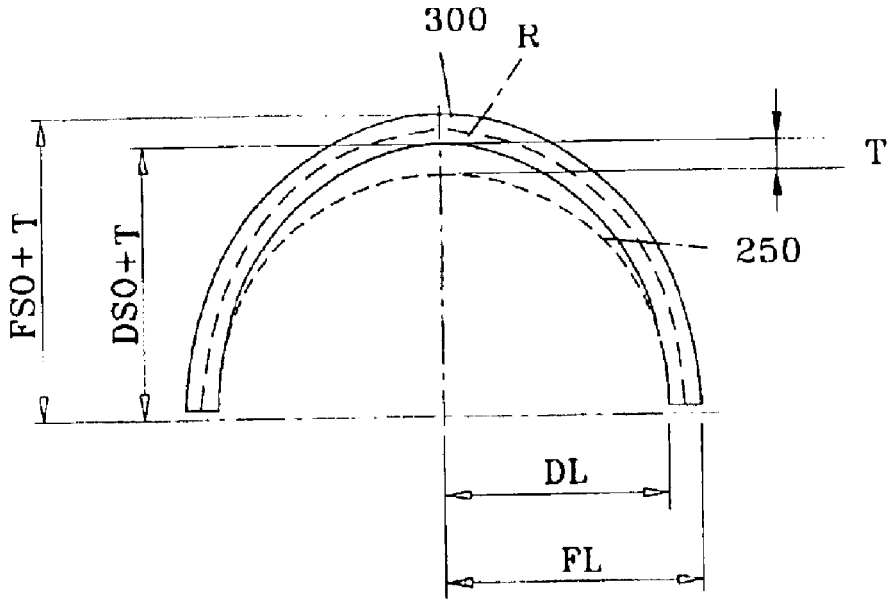
FIG. 15 is a cross-sectional view taken along k–k' of FIG. 13B.

FIG. 14 is a cross-sectional view taken along j–j' of FIG. 13B, and FIG. 15 is a cross-sectional view taken along k–k' of FIG. 13B.

Although FIGS. 11 through 15 shows a deflection coil representing the horizontal deflection coil 70 generating a horizontal deflection magnetic field, an explanation of a vertical deflection coil 90 will be omitted since the horizontal deflection coil 70 and the vertical deflection coil 90 have the same structure and operation. The horizontal deflection coil 70 and the vertical deflection coil 90 are collectively called the deflection coil.

As shown in FIG. 11, the deflection yoke 100 is a saddle-saddle type having horizontal and vertical deflection coils formed with a wound coil in a winding frame. The deflection yoke 100 is symmetrical and includes a coil separator 80 having portions formed in an integrated body.

The deflection yoke 100 includes the horizontal deflection coil 70 mounted on an inside of the coil separator 80 to generate a horizontal deflection magnetic field and the vertical deflection coil 90 mounted on an outside of the coil separator 80 to generate a vertical deflection magnetic field.

The deflection yoke 100 further includes a ferrite core 95 formed on an outside surface of the vertical deflection coil 90 to strengthen the horizontal and vertical deflection magnetic fields generated from the horizontal deflection coil 70 and the vertical deflection coil 90, respectively.

In FIGS. 12 through 13C, the horizontal deflection coil 70 and the coil separator 80 includes a screen portion 210 closely attached to an rear portion (not shown) of the screen of the CRT.

An extension portion 200 is extended from the screen portion 210 toward a backward direction of the CRT and generates the horizontal deflection magnetic field for deflecting the electron beam in a horizontal direction.

The extension portion 200 includes a horn shaped section 220 having a horn shaped curve in an axial direction of the CRT and a first section 250 having an inside diameter same as an outer diameter of an electron gun so that the first section 250 of the extension portion 200 is mounted on (inserted around) an outer circumferential surface of the electron gun.

A second section 300 is extended from the first section 250 of the extension portion 200 and generates a second vertical deflection magnetic field which is unnecessary to the horizontal deflection magnetic field of the horizontal deflection coil 70.

The second section 300 is called a neck bent portion since the second section is disposed on (inserted around) a neck portion formed with the electron gun of the CRT.

The second section 300 of the horizontal deflection coil 70 does not generate a necessary magnetic field to the horizontal deflection magnetic field to deflect the electron beam in the horizontal direction but generates the unnecessary magnetic field (the second vertical deflection magnetic field). Accordingly, the second section 300 is defined (called) as a non-effective bent section.

The second section 300 has a radius greater than that of the first section 250 to weaken the second vertical deflection magnetic field, which is unnecessarily generated, thereby extending a beam strike neck (BSN) distance which has the same meaning as a conventional deflection yoke of the related art.

The cross-section area of the second section 300 is greater than that of the first section 250 by depressing an upper front portion of the second section 300 or the first section 250. The second section 300 of the horizontal deflection coil 70 may be extended outwardly in a radial direction of the horizontal deflection coil 70 to have a greater cross-section than the first section 250.

The first section 250 of the horizontal deflection coil 70 is different from that of a conventional horizontal deflection coil by a depth d since the upper front portion of the second section 300 (the first section 250) is depressed as shown in FIG. 13B.

The first section 250 of the coil separator 80 has the same depth d as the upper front portion of the first section 250 of the horizontal deflection coil 70.

The first section 250 of the horizontal deflection coil 70 is formed to be smaller than that of the conventional horizontal deflection coil in radius by the depth d, and the second section 300 of the horizontal deflection coil 70 is formed to be greater than the conventional horizontal deflection coil in radius by a gap T as shown in FIG. 13B.

The gap T is about 0.05–0.5 mm in consideration of a margin in designing the deflection yoke 100.

The coil separator 80 and the horizontal deflection coil 70 having a structure as described above are formed with the screen portion 210 and the second section 300 in an integral single body or a monolithic single body.

As shown in FIGS. 14 and 15, a mean (section) radius R of a cross-section area is calculated by a mean value of an inside radius and an outside radius of the cross-section area.

FIG. 15 shows the section radius R of the second section 300 of the horizontal deflection coil 70 in detail, and since the coil separator 80 is formed in the same manner as the horizontal deflection coil 70 in terms of the section radius R, an explanation of the coil separator 80 will be omitted.

The section radius R in an upper portion of the second section of the horizontal deflection coil 70 is greater than that of the first section 25 by the gap T.

The second section 300 may have inside radii DL and DSO in the horizontal direction and the vertical direction, respectively, and outside radii FL and FSO in the horizontal direction and the vertical direction, respectively, which are greater that those of the first section of FIG. 14 by the gap T, as well as the section radius R. The second section 300 also may have an inside radius DL or DSO in the horizontal or vertical direction and an outside radius FL or FSO in the horizontal or vertical direction, which are greater that those of the first section of FIG. 14 by the gap T.

A value of the section radius R of the second section 300 is a mean value of the inside radius DL or DSO+T and the outside radius FL or FSO+T.

The section radius R of the second section 300 is increased by the gap T together with the inside radius DL or DSO and the outside radius FL or FSO, which are increased by the gap T. Accordingly, the inside radius DSO becomes DSP+T, and the outside radius FSO becomes FSO+T.

The section radius R and the inside and outside radii DL, DSO, FL, FSO are greater in vertical direction that those in the horizontal direction.

The section radius R and the inside and outside radii DL, DSO, FL, FSO are different in the horizontal direction and the vertical direction.

When the deflection yoke 100 is combined with the electron gun of the CRT, the second section 300 (neck bent portion) is spaced-apart from an outer circumferential surface of the electron gun, and the second vertical deflection magnetic field is weakened with respect to the electron beam of the electron gun.

The coil separator 80 has the same structure and shape as the horizontal deflection coil 70 and has another section radius and another inside and outside radii corresponding to the section radius R and the inside and outside radii DL, DSO, FL, FSO, respectively.

The another section radius of-the second section 300 of the coil separator 80 is increased by the gap T together with the another inside radius and the outside radius, which are increased by the gap T.

The another section radius and the inside and outside radii of the coil separator 80 are greater in vertical direction than those in the horizontal direction.

The another section radius and the another inside and outside radii of the coil separator 80 are different in the horizontal direction and the vertical direction.

Therefore, respective first and second sections 250, 300 of the horizontal deflection coil 70 can be combined with the coil separator 80 in the integrated single body since the structure of the horizontal deflection coil 70 is identical to the coil separator 80.

The vertical deflection coil 90 may have the same structure as the coil separator 80 and the horizontal deflection coil 70 to have another section radius and another inside and outside radii corresponding to the section radius R and the inside and outside radii DL, DSO, FL, FSO, respectively. The vertical deflection coil 90 may be formed with the another section radius and the another inside and outside radii, which are different in the horizontal direction and the vertical direction, to weaken a second horizontal deflection magnetic field generated from another second section 300 of the vertical deflection coil 90, thereby causing the BSN distance to be extended.

A rear portion of the deflection yoke 100 formed with the horizontal deflection coil 70 installed on the inside of the coil separator 80 shows a space corresponding to the gap T as shown in FIG. 11. The gap narrows in a direction toward right and left sides from an uppermost side. A material layer may be disposed in the space between the electron gun and the horizontal deflection coil 70 of the deflection yoke 100 and may be made of a material, such as an adhesive, an insulator, etc. The material has a first thickness corresponding to the gap T in a radial direction and a second thickness less than the first thickness in response to the narrowing gap.

Accordingly, when the deflection yoke 100 is combined with the electron gun of the CRT, an outside surface of the electron gun is spaced-apart from the rear portion of the deflection yoke 100, and the electron gun is spaced-apart from the second section 300 of the horizontal deflection coil 70 by a distance which may correspond to the gap T. The electron beam emitted from the electron gun is disposed at a distance from the second section 300 of the horizontal deflection coil 70 more than the conventional deflection yoke.

When the electron beam is disposed away from the second section 300, the unnecessary magnetic field, e.g., second vertical deflection magnetic field, generated from the second section 300 of the horizontal deflection coil 70 affects the electron beam less than the conventional deflection yoke, thereby increasing the BSN distance.

The unnecessary magnetic field generated from the second section 300 is weakened in terms of an influence on the electron beam.

When the upper front portion of the second section, e.g., the first section 250, is depressed by the depth d, the inside and outside radii of the first section 250 of the horizontal deflection coil 70 is shortened, and the electron beam of the electron gun become closer to the first section of the horizontal deflection coil 70. The horizontal deflection magnetic field is strengthened in terms of an influence on the electron beam.

The electron beam is more influenced by the horizontal deflection magnetic field generated from the first section 250 of the extension portion 200.

The first section 250 becomes closer to the electron beam, and the second section 300 is more spaced-apart from the electron beam. Accordingly, the horizontal deflection magnetic field generated from the first section 250 is strengthened, and the unnecessary magnetic field generated from the second section 300 is weakened.

In a case that the horizontal deflection magnetic field is strengthened, a horizontal deflection of the electron beam is improved, and the BSN distance is lengthened (extended) due to the weakened unnecessary magnetic field (weakened second vertical deflection magnetic field).

The vertical deflection coil 90 may have the another first section and the another second section of which section radii are different from each other, and the vertical deflection magnetic field of the another first section is strengthened while the second horizontal deflection magnetic field (unnecessary magnetic field) is weakened. Therefore, a vertical deflection of the electron beam is improved, and the BSN distance is extended at the same time.

The deflection yoke 100 may have the horizontal deflection coil 70 as a horizontal deflection magnetic field generator and the vertical deflection coil 90 having a coil wound around the ferrite core 95 mounted on a circumferential surface of the coil separator 80.

The deflection yoke 100 may have a saddle-toroidal type in which the horizontal deflection coil 70 is a saddle type while, the vertical deflection coil 90 is a toroidal type.

Since the deflection coil of the saddle toroidal type deflection yoke has the same structure and operation as the deflection yoke 100, an explanation of the saddle-toroidal type deflection yoke is omitted.

Figure 16A:
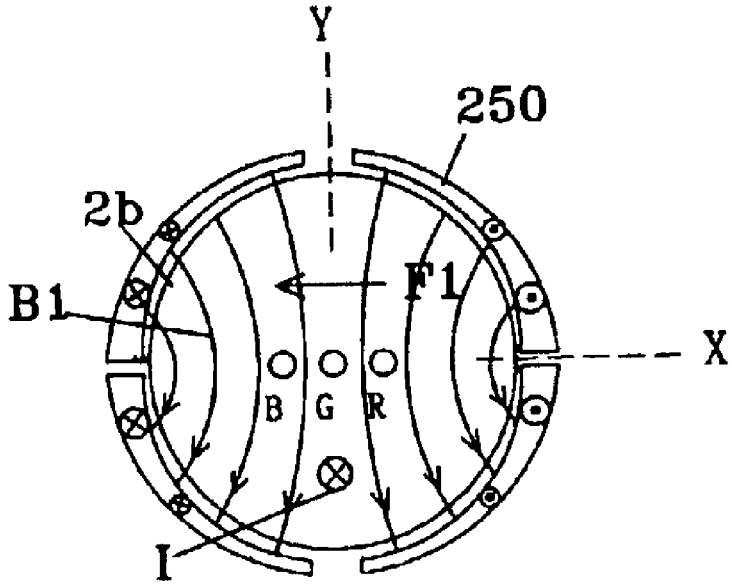
FIGS. 16A and 16B are diagrams showing magnetic fields generated in a first section and a second section, respectively, of the horizontal deflection coil of the deflection yoke shown in FIGS. 13A, 13B and 13C.
Figure 16B:
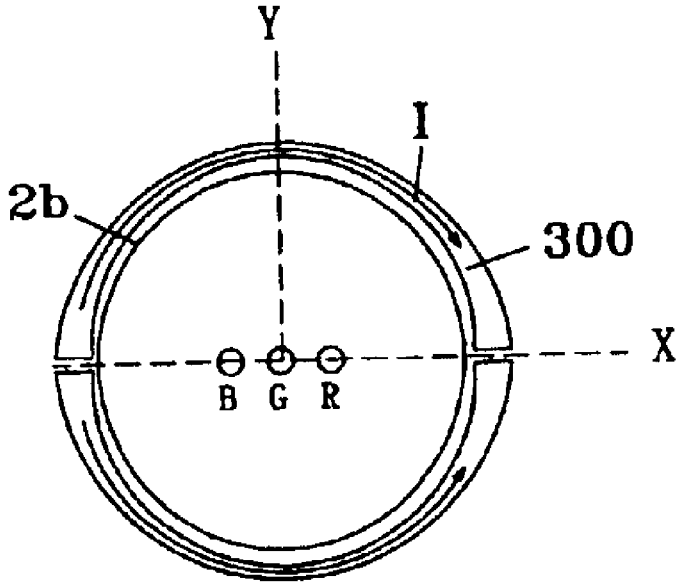

FIGS. 16A and 16B are diagrams showing magnetic fields generated in the first section 250 and the second section 300, respectively, of the horizontal deflection coil 70 of the deflection yoke 1 shown in FIG. 11.

The horizontal deflection magnetic field B1 as a pin magnetic field is generated in the first section 250 in response to an input current and deflects the electron beam in a Y direction, and a horizontal deflection force F1 is generated in an X direction in the first section 250 in response to the horizontal deflection magnetic field B1 and a reversed current flowing in a reverse direction of the electron beam.

Since the first section. 250 has the inside radius which is reduced by the depth d as described above, a distance between the first section 250 and the electron beam is shortened, and the horizontal deflection force F1 is more strengthened than the conventional deflection yoke.

In the second section 300, the current I flows in a right direction of the X direction. Although the second vertical deflection magnetic field in the Y direction due to the current, the electron beam is less influenced by the second vertical deflection magnetic field than the conventional deflection yoke since a space corresponding to the gap T is formed between an upper surface of the electron gun and a lower surface of the second section 300.

Therefore, the horizontal deflection magnetic field generated from the first section 250 becomes stronger, and the second vertical deflection magnetic field generated from the second section 300 does not affect a path of the electron beam in the second section 300.

Figure 17:
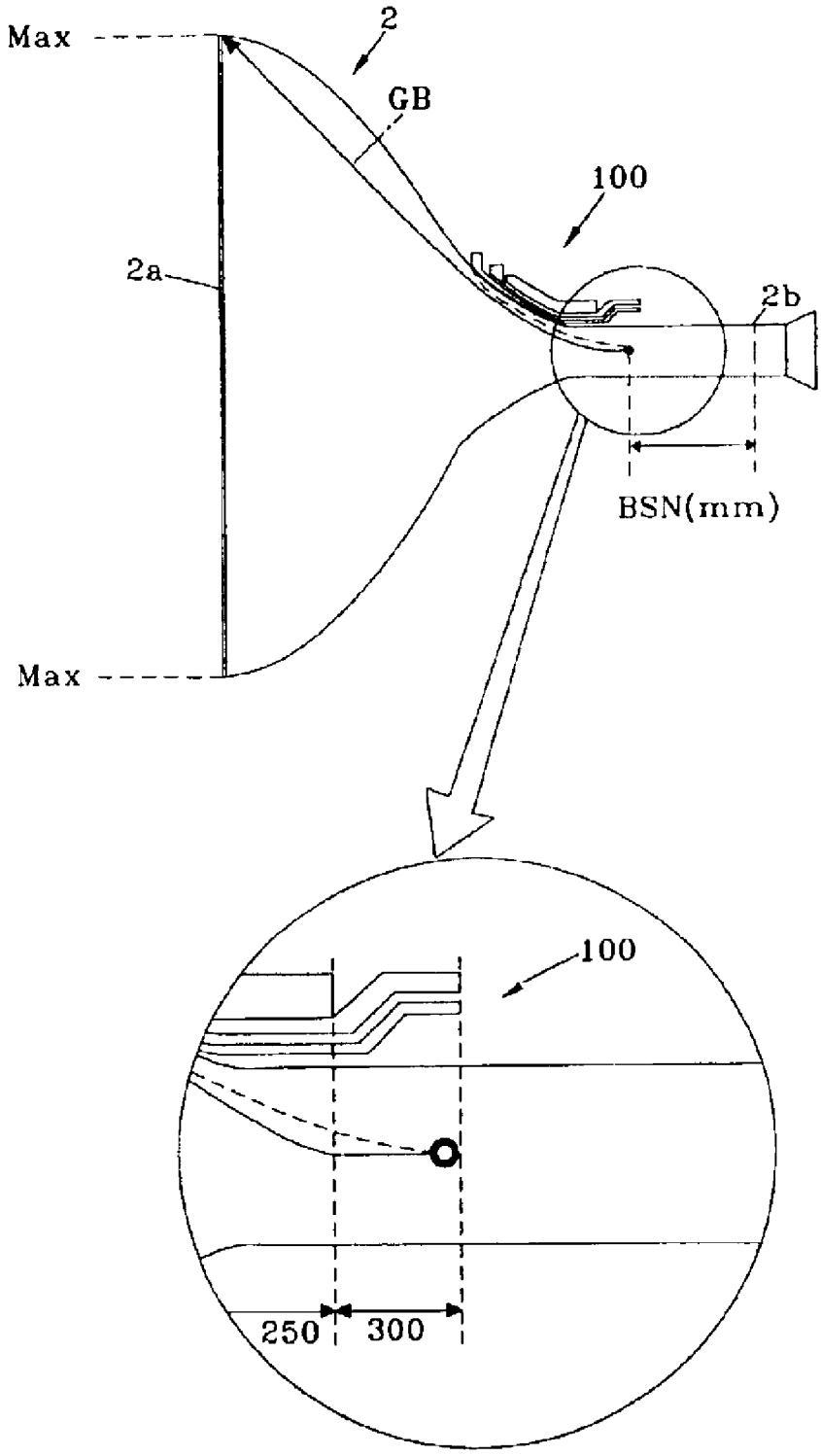
FIG. 17 is a diagram showing a deflection sensitivity and a BSN phenomenon of the deflection yoke shown in FIG. 11.

FIG. 17 is a diagram showing a deflection sensitivity and a BSN phenomenon of the deflection yoke 1 shown in FIG. 11. The deflection yoke 100 is not closely attached to a rear side of the CRT but moves backward toward the electron gun to be coupled to the electron gun of the CRT to adjust a convergence.

Since the electron beam GB moves in a straight direction parallel to the axial direction of the CRT in the second section 300 due to the magnetic field of the second section 300 formed on a rear portion of the deflection yoke 100, the BSN distance is extended toward a rearmost side of the CRT.

A broken line is a deflection path of the electron beam of the conventional deflection yoke, and the electron beam starts being deflected in the second section 300 due to the unnecessary magnetic field, e.g., the second vertical deflection magnetic field, generated from the second section 300 and strikes an inside of the electron gun 2*b* of the CRT.

A solid line is another deflection path of the electron beam of the deflection yoke 100, the electron beam GB is not influenced by the second deflection magnetic field in the second section 300 but forwards along the straight direction, and the electron beam GB is sharply deflected in the first section due to the horizontal deflection force F1 generated from the first section 250 and is able to reach a maximum point of the screen corresponding to one of an uppermost side, a lowermost side, a rightmost side, and a leftmost side of the screen.

As described above, the second section 300 is spaced-apart from an outer surface of the electron gun, and the electron beam GB is not influenced by the unnecessary magnetic field generated from the second section 300 but is able to maintain the straight line within the second section 300.

However, the electron beam GB is sharply deflected in the first section 250 in accordance with the horizontal deflection magnetic field generated from the first section 250 after passing through the second section 300.

A deflection point of the electron beam GB is not disposed within the second section 300 but in the first section 250.

The BSN distance of the deflection yoke 100 can be extended since the electron beam GB is not deflected within the second section 300.

Even though the BSN distance is extended, the electron beam GB can reach the maximum point of the screen.

Even though the same current consumed in the convention deflection yoke is input to the deflection yoke 100, the electron beam GB can reach the maximum point of the screen, and the deflection sensitivity is improved since a value of the deflection sensitivity is lowered.

The consumed current supplied to the deflection yoke 100 can be reduced according to the magnetic field of the first section 250 since the deflection magnetic field, which is intensified by a shortened inside radius of the first section, strongly affect the electron beam GB, thereby improving the deflection sensitivity of the deflection yoke 100.

Figure 18A:
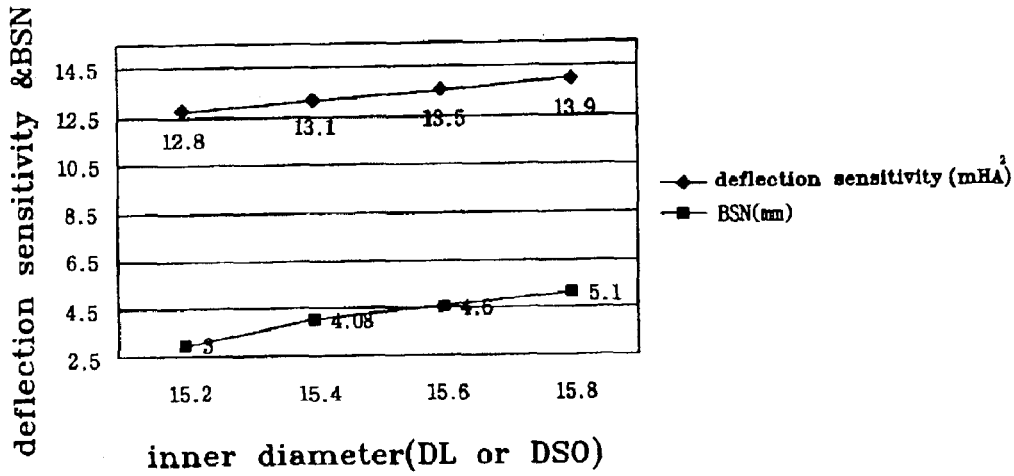
FIG. 18A (PRIOR ART)
FIGS. 18A and 18B showing the deflection sensitivity and the BSN phenomenon according to an inner diameter of a conventional deflection yoke and the deflection yoke shown in 10 FIG. 11, respectively.
Figure 18B:
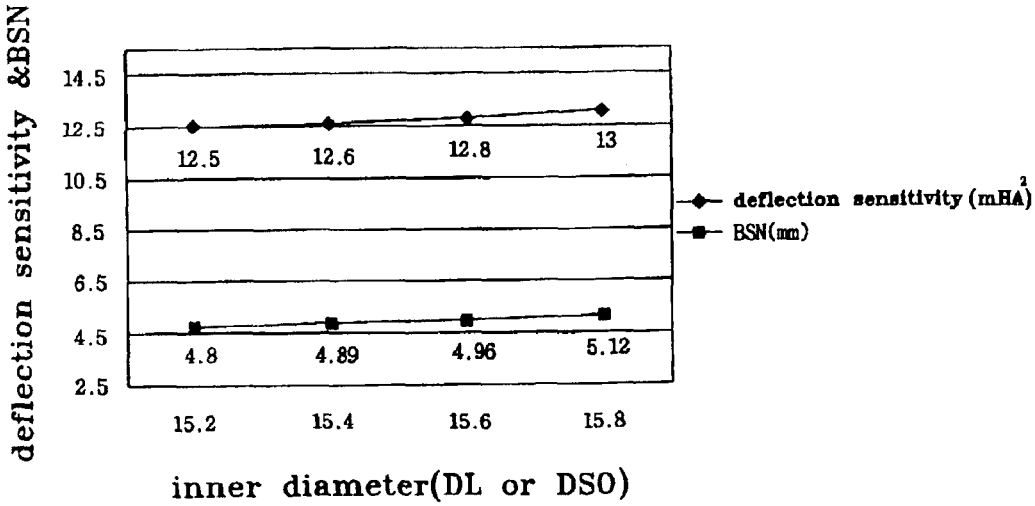
Figure 19A:
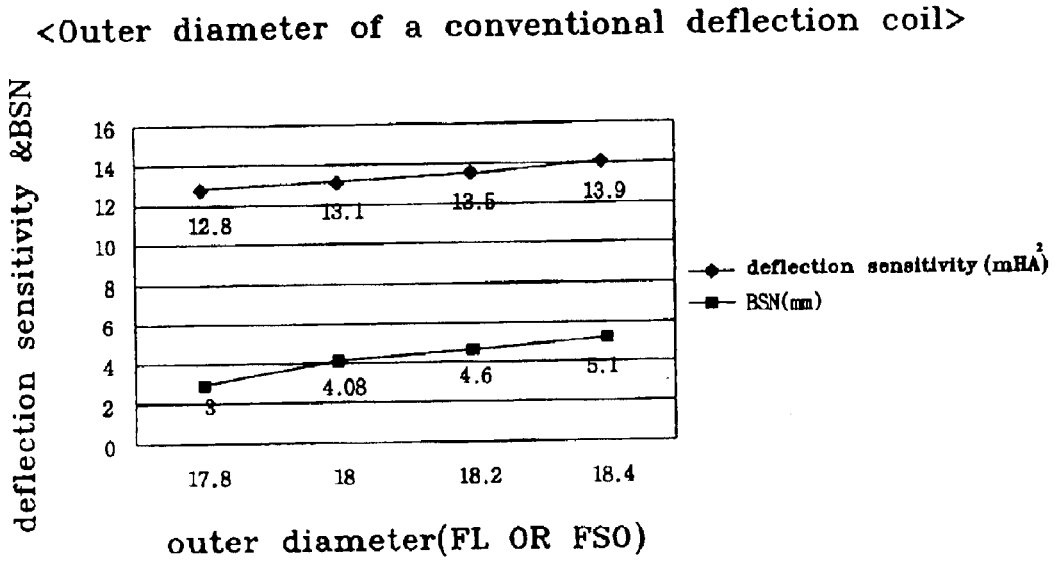
FIG. 19A (PRIOR ART)
FIGS. 19A and 19B showing the deflection sensitivity and the BSN phenomenon according to an outer diameter of a conventional deflection yoke and the deflection yoke shown in FIG. 11, respectively.
Figure 19B:
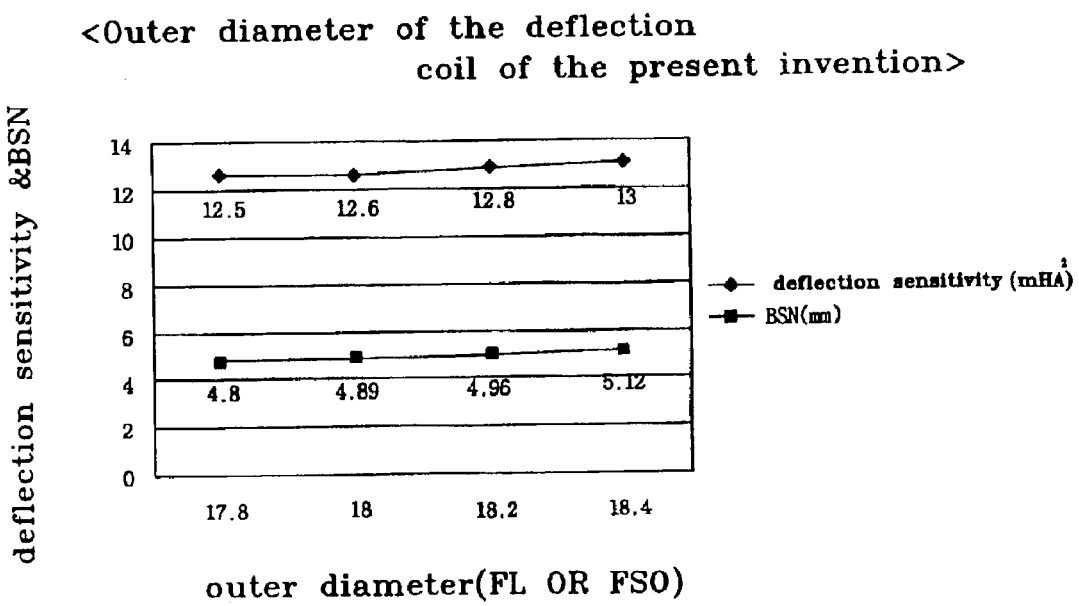

FIGS. 18A and 18B showing the deflection sensitivity and the BSN phenomenon according to the inner radius of the conventional deflection yoke and the deflection yoke 100 shown in FIG. 11, respectively. FIGS. 19A and 19B showing the deflection sensitivity and the BSN phenomenon according to the outside radius of the conventional deflection yoke and the deflection yoke shown in FIG. 11, respectively.

In FIG. 18A, the deflection sensitivity is 13.9, and a BSN value corresponding to the BSN distance is 5.1 when the inside diameter of a deflection coil of the conventional deflection yoke is 15.8 mm.

In FIG. 18B, the deflection sensitivity is 13, and the BSN value corresponding to the BSN distance is 5.12 when the inside diameter of the deflection coil of the deflection yoke 10 is 15.8 mm according to the embodiment of the present invention.

According to the above diagram, the deflection yoke 100 of the invention shows that the deflection sensitivity and the BSN distance are improved.

In FIG. 19A, the deflection sensitivity is 13.9, and the BSN value corresponding to the BSN distance is 5.1 when the outside diameter of the deflection coil of the conventional deflection yoke is 18.4 mm.

In FIG. 19B, the deflection sensitivity is 13, and the BSN value corresponding to the BSN distance is 5.12 when the outside diameter of the deflection coil of the deflection yoke 10 according to the embodiment of the present invention is 18.4 mm.

According to the above diagram relating to the outside diameter, the deflection yoke 100 of the invention shows the same result as the inside diameter of the deflection yoke 100. The deflection sensitivity and the BSN distance are also improved.

Figure 20:
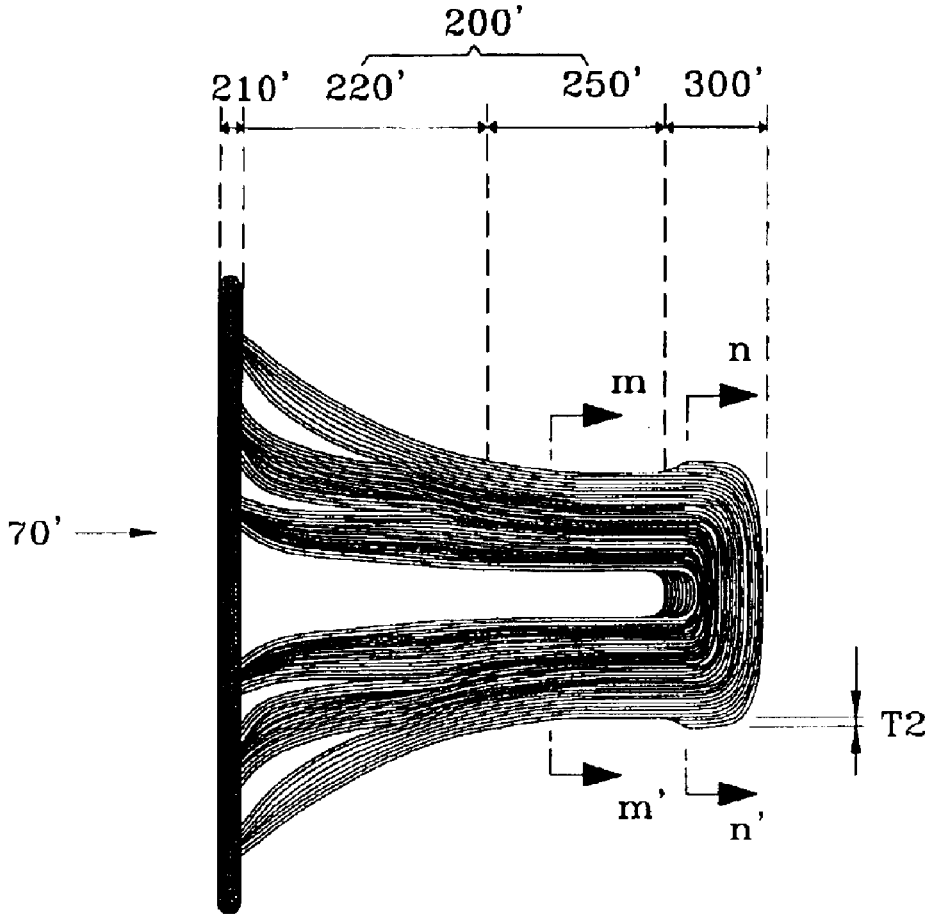
FIG. 20 is a cross-sectional view of another horizontal deflection coil of a deflection yoke according to another embodiment of the present invention.
Figure 21:
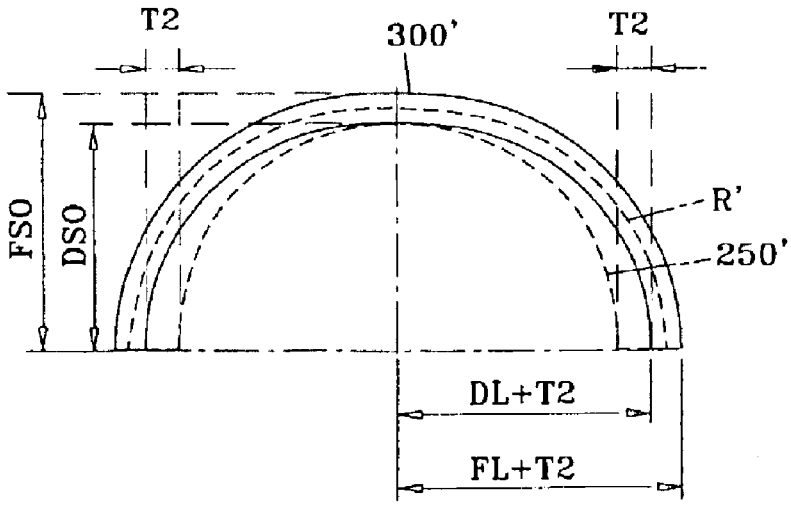
FIG. 21 is a cross-sectional view taken along m–m' and n–n' of FIG. 20.

To the contrary, the inside and outside radii of the second section 300 of the horizontal deflection coil 70 may be enlarged in the horizontal direction rather than in the vertical direction as shown in FIGS. 20 and 21, to extend the BSN distance.

FIG. 20 is a cross-sectional view of another horizontal deflection coil of the deflection yoke 100 according to another embodiment of the present invention, and FIG. 21 is a cross-sectional view taken along m–m' and n–n' of FIG. 20. A horizontal deflection coil 70' is described in FIGS. 20 and 21, and an explanation of a vertical deflection coil is omitted since the horizontal deflection coil and the vertical deflection coil have the same structure and operation.

As shown in FIGS. 20 and 21, the horizontal deflection coil 70' which is similar to the horizontal deflection coil 70 of FIGS. 12 and 13C, includes a screen portion 210', an extension portion having a horn shaped section 220' extended from the screen portion and a first section extended from the horn shaped section 220', and a second section 300 formed with the extension portion 200' in an integrated single body.

The first section 250' and the second section 300' have a different radius, and a section radius of the second section 300' is greater than that of the first section 250'.

The second section 300' may have the section radius in the horizontal direction (left and right sides) greater than that in the vertical direction (upper side).

The section radius of the right and left sides of the second section 300' is greater than that of the upper side of the second section 300' by depressing an upper front portion of the second section 300'. The inside and outside radii of the first section 250'of the horizontal deflection coil 70' is decreased by the depth d to increase the horizontal deflection magnetic field in response to a decrease of the inside or outside radius of the first section 250'.

An enlarged portion of the radius of the right and left sides of the horizontal deflection coil 70' is indicated as the gap T.

When the section radius of the second section 300' is greater than that of the first section 250', an inside surface of the second section 300' is disposed at a distance from an outside surface of the first section 250', and the BSN distance is extended since the electron beam is less influenced by the second deflection magnetic field generated from the second section 300'.

The BSN distance is extended since the electron beam is not deflected in the second section 300' but deflected in the first section 250'.

The electron beam moves forward straight within the second section 300' since the electron beam is not influenced by the second deflection magnetic field, and the electron beam is sharply deflected in the first section 250' and reaches the maximum point of the screen due to the horizontal deflection magnetic field of the first section 250'.

The second section 300' of the coil separator 80 may be formed to correspond to the second section 300' of the horizontal deflection coil 70'. Thus, an explanation of the coil separator 80 is omitted.

As described above, even though the deflection yoke 100 moves backward toward the electron gun 2*b* to adjust the convergence, the unnecessary magnetic field generated from the rear portion of the deflection yoke 100 can be weakened, and the BSN distance is extended by preventing the electron beam from being influenced by the unnecessary magnetic field.

In addition, a relatively small amount of the consumed current may used for scanning the electron beam to the maximum point of the screen, and the deflection sensitivity can be improved.

Since the electron beam GB reaches the maximum point of the screen 2*a*, a screen image can be displayed on the screen 2*a*, and a defect occurring when the electron beam GB is not completely deflected toward the screen 2*a* can be avoided.

A tilting of the deflection yoke 100 is enabled due to the enlarged inside and outside radius and the section radius of the second section 300, 300', and a manufacturing process is improved. A scanning width of the electron beam is enlarged in accordance with the deflection sensitivity of the deflection yoke, thereby improving a product quality of the deflection yoke.

Although a few preferred embodiments of the present invention have been shown and described, it would be appreciated by those skilled in the art that changes may be made in this embodiment without departing from the principle and sprit of the invention, the scope of which is defined in the claims and their equivalent.

What is claimed is:

1. A deflection yoke mounted on a rear portion of a cathode ray tube (CRT) to deflect an electron beam emitted from an electron gun of the CRT, comprising:

a coil separator mounted on the CRT;

a horizontal deflection coil mounted on an inside of the coil separator, having a first section generating a horizontal deflection magnetic field deflecting the electron in a horizontal direction and having a first section radius, having a second section generating an unnecessary magnetic field weakening the horizontal deflection magnetic field and having a second section radius different from the first section radius;

a vertical deflection coil mounted on an outside of the coil separator and generating a vertical deflection magnetic field deflecting the electron beam in a vertical direction; and a ferrite core covering a portion of the vertical deflection coil to strengthen the horizontal deflection magnetic field and the vertical deflection magnetic field;

wherein the first and second sections of the horizontal deflection coil comprise an inside radius, wherein the inside radius of the second section is different from that of the first section;

wherein the second section comprises a first sub-inside radius in a first direction and a second sub-inside radius in a second direction perpendicular to the first direction, and the first sub-inside radius is different from the second sub-inside radius.

2. A deflection yoke mounted on a rear portion of a cathode ray tube (CRT) to deflect an electron beam emitted from an electron gun of the CRT, comprising:

a coil separator mounted on the CRT;

a horizontal deflection coil mounted on an inside of the coil separator, having a first section generating a horizontal deflection magnetic field deflecting the electron in a horizontal direction and having a first section radius, having a second section generating an unnecessary magnetic field weakening the horizontal deflection magnetic field and having a second section radius different from the first section radius;

a vertical deflection coil mounted on an outside of the coil separator and generating a vertical deflection magnetic field deflecting the electron beam in a vertical direction; and a ferrite core covering a portion of the vertical deflection coil to strengthen the horizontal deflection magnetic field and the vertical deflection magnetic field;

wherein the first and second sections of the horizontal deflection coil comprise an outside radius, wherein the outside radius of the second section is different from that of the first section;

wherein the second section comprises a first sub-outside radius in a first direction and a second sub-outside radius in a second direction perpendicular to the first direction, and the first sub-outside radius is different from the second sub-outside radius.

3. A deflection yoke mounted on a rear portion of a cathode ray tube (CRT) to deflect an electron beam emitted from an electron gun of the CRT, comprising:

a coil separator mounted on the CRT;

a horizontal deflection coil mounted on an inside of the coil separator, having a first section generating a horizontal deflection magnetic field deflecting the electron in a horizontal direction and having a first section radius, having a second section generating an unnecessary magnetic field weakening the horizontal deflection magnetic field and having a second section radius different from the first section radius;

a vertical deflection coil mounted on an outside of the coil separator and generating a vertical deflection magnetic field deflecting the electron beam in a vertical direction; and a ferrite core covering a portion of the vertical deflection coil to strengthen the horizontal deflection magnetic field and the vertical deflection magnetic field;

wherein the second section comprises a first sub-section radius in a first direction and a second sub-section radius in a second direction perpendicular to the first direction, and the first sub-section radius is different from the second sub-section radius.

4. A deflection yoke mounted on a rear portion of a cathode ray tube (CRT) to deflect an electron beam emitted from an electron gun of the CRT, comprising:

a coil separator mounted on the CRT;

a horizontal deflection coil mounted on an inside of the coil separator, having a first section generating a horizontal deflection magnetic field deflecting the electron in a horizontal direction and having a first section radius, having a second section generating an unnecessary magnetic field weakening the horizontal deflection magnetic field and having a second section radius different from the first section radius;

a vertical deflection coil mounted on an outside of the coil separator and generating a vertical deflection magnetic field deflecting the electron beam in a vertical direction; and a ferrite core covering a portion of the vertical deflection coil to strengthen the horizontal deflection magnetic field and the vertical deflection magnetic field, wherein the coil separator comprises:

another first section corresponding to the first section of the horizontal deflection coil and having a first inside radius; and another second section corresponding to the second section of the horizontal deflection coil and having a second inside radius different from the first inside radius.

5. A deflection yoke mounted on a rear portion of a cathode ray tube (CRT) to deflect an electron beam emitted from an electron gun of the CRT, comprising:

a coil separator mounted on the CRT;

a horizontal deflection coil mounted on an inside of the coil separator and generating a horizontal deflection magnetic field deflecting the electron beam in a horizontal direction;

a vertical deflection coil mounted on an outside of the coil separator, having a first section generating a vertical deflection magnetic field deflecting the electron beam in a vertical direction and having a first section radius, and having a second section generating an unnecessary magnetic field weakening the vertical deflection magnetic field and having a second section radius different from the first section radius; and a ferrite core covering a portion of the vertical deflection coil to strengthen the horizontal deflection magnetic field and the vertical deflection magnetic field.

6. The deflection yoke of claim 5, wherein the first and second sections of the vertical deflection coil comprise an inside radius, wherein the inside radius of the second section is different from that of the first section.

7. The deflection yoke of claim 6, wherein the inside radius of the second section is greater than that of the first section.

8. The deflection yoke of claim 5, wherein the first and second sections of the vertical deflection coil comprise an outside radius, wherein the outside radius of the second section is different from that of the first section.

9. The deflection yoke of claim 8, wherein the outside radius of the second section is greater than that of the first section.

10. The deflection yoke of claim 5, wherein the section radius of the second section is greater than that of the first section.

11. The deflection yoke of claim 5, wherein the coil separator comprises:

another first section corresponding to the first section of the horizontal deflection coil and having a first inside radius; and another second section corresponding to the second section of the horizontal deflection coil and having a second inside radius different from the first inside radius.

12. A deflection yoke mounted on a rear portion of a cathode ray tube (CRT) to deflect an electron beam emitted from an electron gun of the CRT, comprising:

a coil separator mounted on the CRT;

a horizontal deflection coil mounted on an inside of the coil separator and generating a horizontal deflection magnetic field deflecting the electron beam in a horizontal direction;

a vertical deflection coil mounted on an outside of the coil separator, having a first section generating a vertical deflection magnetic field deflecting the electron beam in a vertical direction and having a first section radius, and having a second section generating an unnecessary magnetic field weakening the vertical deflection magnetic field and having a second section radius different from the first section radius; and a ferrite core covering a portion of the vertical deflection coil to strengthen the horizontal deflection magnetic field and the vertical deflection magnetic field;

wherein the first and second sections of the horizontal deflection coil comprise an inside radius, wherein the inside radius of the second section is different from that of the first section;

wherein the second section comprises a first sub-inside radius in a first direction and a second sub-inside radius in a second direction perpendicular to the first direction, and the first sub-inside radius is different from the second sub-inside radius.

13. A deflection yoke mounted on a rear portion of a cathode ray tube (CRT) to deflect an electron beam emitted from an electron gun of the CRT, comprising:

a coil separator mounted on the CRT;

a horizontal deflection coil mounted on an inside of the coil separator and generating a horizontal deflection magnetic field deflecting the electron beam in a horizontal direction;

a vertical deflection coil mounted on an outside of the coil separator, having a first section generating a vertical deflection magnetic field deflecting the electron beam in a vertical direction and having a first section radius, and having a second section generating an unnecessary magnetic field weakening the vertical deflection magnetic field and having a second section radius different from the first section radius; and a ferrite core covering a portion of the vertical deflection coil to strengthen the horizontal deflection magnetic field and the vertical deflection magnetic field;

wherein the first and second sections of the horizontal deflection coil comprise an outside radius, wherein the outside radius of the second section is different from that of the first section wherein the second section comprises a first sub-outside radius in a first direction and a second sub-outside radius in a second direction perpendicular to the first direction, and the first sub-outside radius is different from the second sub-outside radius.

14. A deflection yoke mounted on a rear portion of a cathode ray tube (CRT) to deflect an electron beam emitted from an electron gun of the CRT, comprising:

a coil separator mounted on the CRT;

a horizontal deflection coil mounted on an inside of the coil separator and generating a horizontal deflection magnetic field deflecting the electron beam in a horizontal direction;

a vertical deflection coil mounted on an outside of the coil separator, having a first section generating a vertical deflection magnetic field deflecting the electron beam in a vertical direction and having a first section radius, and having a second section generating an unnecessary magnetic field weakening the vertical deflection magnetic field and having a second section radius different from the first section radius; and a ferrite core covering a portion of the vertical deflection coil to strengthen the horizontal deflection magnetic field and the vertical deflection magnetic field;

wherein the second section comprises a first sub-section radius in a first direction and a second sub-section radius in a second direction perpendicular to the first direction, and the first sub-section radius is different from the second sub-section radius.

* * * * *